US006935152B2

(12) United States Patent
Dole et al.

(10) Patent No.: US 6,935,152 B2
(45) Date of Patent: Aug. 30, 2005

(54) ORBITING ROLLER GROOVER FOR PIPE

(75) Inventors: Douglas R. Dole, Whitehouse Station, NJ (US); Ronald R. Snyder, Sr., Schnecksville, PA (US)

(73) Assignee: Victaulic Company of America, Easton, PA (US)

( * ) Notice: Subject to any disclaimer, the term of this patent is extended or adjusted under 35 U.S.C. 154(b) by 203 days.

(21) Appl. No.: 10/414,546

(22) Filed: Apr. 15, 2003

(65) Prior Publication Data

US 2003/0226387 A1 Dec. 11, 2003

Related U.S. Application Data

(60) Provisional application No. 60/372,829, filed on Apr. 16, 2002.

(51) Int. Cl.[7] ..... B21D 15/04

(52) U.S. Cl. ..... 72/105; 72/107; 72/121; 72/123; 72/125; 72/393

(58) Field of Search ..... 72/118, 105, 106, 72/107, 110, 121, 122, 123, 125, 126, 393

(56) References Cited

U.S. PATENT DOCUMENTS

| | | | | |
|---|---|---|---|---|
| 1,295,614 A | | 2/1919 | Scrimgeour | |
| 1,610,193 A | | 12/1926 | Battle | |
| 2,236,443 A | | 3/1941 | Oboler | 33/178 |
| 2,572,999 A | | 10/1951 | Elliott | 33/178 |
| 2,659,982 A | | 11/1953 | Jakobi | 33/178 |
| 3,299,680 A | * | 1/1967 | Thompson | 72/6.2 |
| 3,473,359 A | | 10/1969 | Joslin | 72/121 |
| 3,541,826 A | | 11/1970 | Halliburton | 72/105 |
| 3,563,077 A | | 2/1971 | Backe et al. | 72/108 |
| 3,674,832 A | | 7/1972 | Bedker et al. | 72/35 |
| 3,903,722 A | | 9/1975 | Thau, Jr. et al. | 72/105 |
| 3,995,466 A | | 12/1976 | Kunsman | 72/106 |
| 4,030,330 A | * | 6/1977 | Nyssen et al. | 72/105 |
| 4,041,747 A | | 8/1977 | Elkin | 72/105 |
| 4,091,648 A | | 5/1978 | McCaslin | 72/121 |
| 4,114,414 A | * | 9/1978 | Goodman | 72/105 |
| 4,143,535 A | | 3/1979 | Bouman | 72/119 |
| 4,160,329 A | | 7/1979 | Scrimshaw | 33/178 D |

(Continued)

FOREIGN PATENT DOCUMENTS

GB 2 266 482 11/1993 ..... B21D/15/06

OTHER PUBLICATIONS

Phoenix Fire Systems, Inc. "Ultra–Lok" Products for Fire Sprinkler Piping System Brochure (undated).

Victaulic® Tool Company VE–226 Operating Instructions for Roll Groovers (16 page manual) undated.

Victaulic® Tool Company Operating and Maintenance Instructions Manual for VE270FSD Pipe Roll Grooving Tool (34 page manual) dated Sep. 1998.

Victualic ® Tool Company Operating and Maintenance Instructions Manual for VE416FS & VE416FSD Pipe Roll Grooving Tools (35 page manual) dated May 1997.

*Primary Examiner*—Ed Tolan
(74) *Attorney, Agent, or Firm*—Synnestvedt & Lechner LLP

(57) ABSTRACT

An apparatus and method for forming grooves in a pipe for receiving mechanical pipe clamps are disclosed. The apparatus includes a holding fixture for securing the pipe and a carriage rotatably mounted on the holding fixture. Two arms are pivotably mounted on the carriage and extend on opposite sides of the pipe. Each arm has a grooving roller rotatably mounted thereon. An actuator connects the arms and forces the grooving rollers into engagement with the pipe. The carriage, arms, actuator and grooving rollers are rotated about the pipe in an orbit to form the circumferential groove. The method steps include forcing the grooving roller into the surface of the pipe at a fixed rate per revolution of the grooving rollers about the pipe in the orbit.

23 Claims, 11 Drawing Sheets

U.S. PATENT DOCUMENTS

| | | | | | |
|---|---|---|---|---|---|
| 4,166,370 | A | | 9/1979 | Goodman | 72/105 |
| 4,336,703 | A | | 6/1982 | Thomas | 72/104 |
| 4,430,024 | A | | 2/1984 | Guild et al. | 405/232 |
| 4,445,352 | A | | 5/1984 | Pols | 72/101 |
| 4,454,739 | A | | 6/1984 | Ciccorelli | 72/23 |
| 4,736,607 | A | | 4/1988 | Wochnik | 72/177 |
| 4,781,233 | A | | 11/1988 | Williams | 157/16 |
| 5,079,940 | A | | 1/1992 | Pulver et al. | 72/102 |
| 5,104,031 | A | | 4/1992 | Wolfe | 228/154 |
| 5,150,595 | A | | 9/1992 | Ihly | 72/124 |
| 5,291,769 | A | | 3/1994 | Miyano | 72/121 |
| 5,450,738 | A | | 9/1995 | Chatterley et al. | 72/106 |
| 5,467,627 | A | * | 11/1995 | Smith et al. | 72/121 |
| 5,477,720 | A | | 12/1995 | Lentz et al. | 72/124 |
| 5,481,893 | A | | 1/1996 | Barjasteh et al. | 72/107 |
| 5,528,919 | A | | 6/1996 | McGrady et al. | 72/121 |
| 5,535,938 | A | | 7/1996 | Leduc | 228/212 |
| 5,727,411 | A | | 3/1998 | Sakakibara et al. | |
| 5,778,715 | A | | 7/1998 | Lippka et al. | 72/106 |
| 5,950,472 | A | | 9/1999 | Grotnes et al. | 72/105 |
| 6,018,972 | A | * | 2/2000 | Irie | 72/121 |
| 6,164,106 | A | | 12/2000 | Nghiem et al. | 72/20.1 |
| 6,196,039 | B1 | | 3/2001 | Williams et al. | 72/105 |
| 6,244,088 | B1 | | 6/2001 | Compton | 72/105 |
| 6,272,895 | B1 | | 8/2001 | Hamm | 72/105 |
| 6,666,062 | B2 | * | 12/2003 | Dole et al. | 72/121 |

* cited by examiner

ORBITING ROLLER GROOVER FOR PIPE

RELATED APPLICATION

This application is based on and claims priority to U.S. Provisional Application No. 60/372,829, filed Apr. 16, 2002.

FIELD OF THE INVENTION

The invention concerns an apparatus for forming a circumferential groove in the outer surface of a pipe to enable the pipe to be joined to another pipe by a mechanical pipe coupling that engages the groove. The apparatus is especially useful for grooving thick walled pipes, curved pipe segments and pipe assemblies.

BACKGROUND OF THE INVENTION

As shown in FIG. 1, it is convenient to join pipe ends 10 and 12 with a mechanical pipe coupling 14. Pipe coupling 14 comprises oppositely disposed coupling portions 16 and 18 that are bolted circumferentially around pipe ends 10 and 12. A seal 20 is captured between the coupling portions and the pipe ends to effect a fluid-tight seal at the joint. As shown in FIG. 2, coupling portions 16 and 18 have arcuate keys 22 that engage circumferential grooves 24 formed in the pipe ends 10 and 12. When installed on the pipe ends with a seal 20, the keys 22 engage the grooves 24 to hold the pipes together and resist axial tension or compression forces, as well as bending moments to effect a reliable, fluid-tight joint between the pipe ends.

It is preferred to form the grooves 24 in the pipe ends by cold working the material between a grooving tool, such as a grooving roller, and a die, the grooving roller being applied to the outer surface of the pipe ends and the die supporting the inside pipe surface directly beneath the grooving roller. When the grooving roller is moved circumferentially around the pipe end and forced against the pipe surface, material is displaced predominately inwardly to form the groove 24, the die receiving the displaced material and forming a corresponding bump 26 on the inside pipe surface.

Forming grooves 24 by cold working the pipe material is preferred to cutting grooves, especially in marine applications where strength and corrosion are important considerations. Cold-worked grooves provide joints having increased corrosion allowance over cut grooves, but it is difficult to form such grooves in thick walled pipe, such as schedule 80 steel pipe. Currently, portable grooving machines are available that attach to the pipe wall and travel around the circumference of the pipe, forming the groove between an outer grooving roller and an inner die roller between which the pipe wall is compressed. Such machines are difficult to control and fatiguing to the operators. Further, they are limited in the amount of force they can effectively apply without producing undue pipe diameter growth and flare, which limits the diameter and wall thickness of the pipes with which they can be used.

Another type of prior art grooving apparatus rotates the pipe relatively to the apparatus. However, it is both difficult and unsafe to form grooves in pipe assemblies or curved pipe segments (known as "bent pipe spools") using such apparatus. Furthermore, even when straight pipe is grooved, pipe stands are necessary to support the pipe as it is rotating and being grooved. It is difficult when using pipe stands to establish and maintain the alignment of the pipe with the grooving apparatus. Proper alignment between the pipe and grooving apparatus is needed to ensure formation of a circumferential groove.

Moreover, prior art grooving apparatus of both types (orbital and rotating) control the dimensions of the groove measuring from the pipe internal surface to the grooved surface. The dimensions of grooves formed by such apparatus are adversely affected by variations in the pipe outer diameter tolerance as well as the tolerances of the pipe wall thickness. The accuracy of the groove dimensions is, thus, dependent on the dimensions of the pipe and will vary in proportion to the variation in pipe dimensions. It is, thus, difficult to attain a desired level of consistency and repeatability in the formation of grooves to ensure quality pipe joints.

In view of the drawbacks associated with prior art grooving apparatus, there is clearly a need for an improved grooving tool that can form grooves in thick walled pipe, pipe assemblies and curved pipe segments conveniently, safely, with repeatability, accuracy and with less operator fatigue.

SUMMARY OF THE INVENTION

The invention concerns an apparatus for forming a circumferential groove in pipe. The apparatus comprises a holding fixture adapted to releasably engage and hold the pipe and a grooving roller having a circumferential groove forming surface engageable with the pipe. The grooving roller is rotatable about an axis of rotation oriented substantially parallel to the long axis of the pipe and is movable in an orbit or reciprocably around the circumference of the pipe.

An actuator is linked with the grooving roller for forcibly engaging the groove forming surface of the roller with the pipe when the grooving roller moves in the orbit around the circumference of the pipe. Means for moving the grooving roller in the orbit are provided, preferably in the form of an electric motor.

Preferably, the holding fixture comprises an expandable die having a plurality of segments positioned around a center axis that is coaxial with the long axis of the pipe. The segments of the die are movable radially outwardly to engage an inner surface of the pipe for holding the pipe. The segments are also movable radially inwardly, away from the inner surface of the pipe, to release the pipe after grooving.

The segments of the expandable die each have a groove therein facing the inner surface of the pipe. The grooves are aligned with one another circumferentially around the center axis and coplanar with the orbit of the grooving roller. The grooves in the die segments are also aligned with the groove forming surface of the grooving roller and act to receive material displaced from the pipe wall when the circumferential groove is formed therein.

Preferably, the apparatus also has a carriage mounted on the expandable die. The carriage is rotatable in the orbit about the center axis, preferably by the aforementioned electric motor. An arm having one end pivotally attached to the carriage extends outwardly therefrom transversely to the center axis of the expandable die. The grooving roller is rotatably mounted on the arm, and the arm is pivotally movable toward and away from the expandable die to enable the groove forming surface of the roller to be engaged with the pipe end held by the expandable die.

Preferably, the actuator is mounted, either directly or indirectly, on the carriage and engages the other end of the arm for pivotally moving the arm toward and away from the expandable die, the actuator being adapted to forcibly move the circumferential groove forming surface into engagement with the pipe when the pipe is held by the expandable die.

The carriage, arm and grooving roller rotate about the pipe in the orbit to form the circumferential groove therein.

It is preferred to have a second arm having one end pivotally attached to the carriage and extending outwardly therefrom transversely to the center axis. The second arm is positioned in spaced relation to the first arm, preferably opposite to it with the expandable die located between the arms.

A second grooving roller is rotatably mounted on the second arm and positioned approximately diametrically opposite to the first grooving roller. The second grooving roller also has a circumferential groove forming surface engageable with the pipe. The second arm, like the first arm, is pivotally movable toward and away from the expandable die.

The actuator is preferably mounted on the first arm and engages the other end of the second arm for pivotally moving both arms toward and away from the expandable die. The actuator is adapted to forcibly move the circumferential groove forming surfaces of both rollers simultaneously into engagement with the pipe when the pipe is held by the expandable die. The carriage, arms, actuator and grooving rollers are rotatable about the pipe in the orbit to form the circumferential groove therein.

Preferably, the holding fixture along with the carriage, arms and grooving rollers are mounted for rotation about first and second axes for aligning them with the long axis of the pipe. It is convenient to orient the axes horizontally and vertically.

To permit the apparatus to adapt to different diameter pipes, one end of at least one arm is pivotably positionable at a plurality of pivot positions located in spaced relation to one another on the carriage. Discrete apertures or slots may be used to provide different pivot positions for mounting the arms.

The circumferential groove forming surfaces on each grooving roller preferably comprise a ridge which extends radially outwardly from the roller. The ridges on each of the grooving rollers may be aligned with one another in a common plane to both form the same groove in the pipe being cold worked. Alternately, the ridges on each of the grooving rollers may be positioned in staggered relation relative to one another in a direction along the axes of rotation of the grooving rollers. Preferably, the ridges are staggered with a spacing relative to one another less than the thickness of the ridges so as to produce circumferential grooves in the pipe which overlap one another and form a single groove having a predetermined width.

DETAILED DESCRIPTION OF THE PRESENTLY PREFERRED EMBODIMENTS

Figure 3:
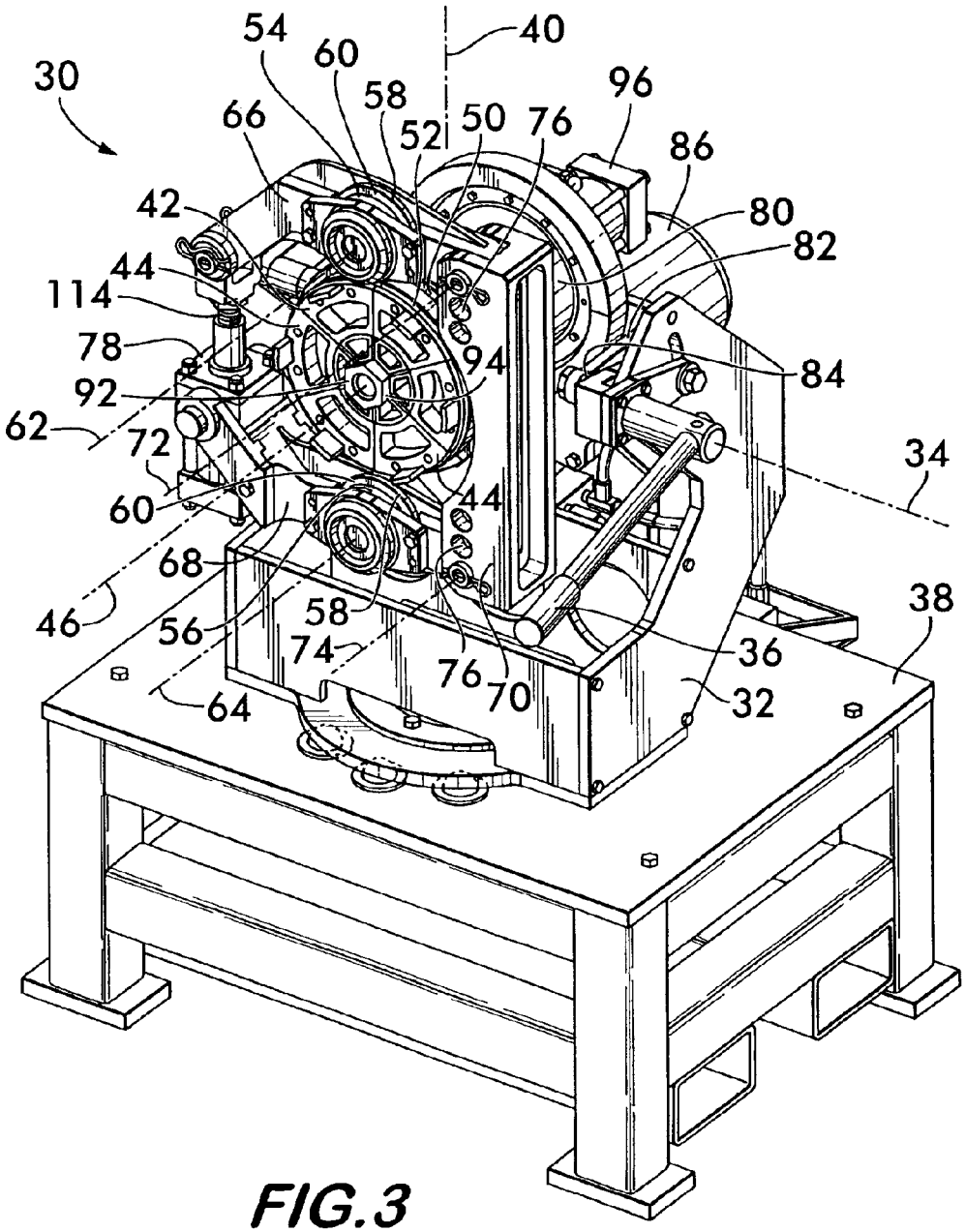
FIG. 3 is a front perspective view of the orbiting roller groover according to the invention.

FIG. 3 shows the orbiting roller groover 30 according to the invention. Groover 30 is mounted on a support frame 32 and is angularly adjustable relatively to the frame 32 about a horizontal axis 34 by means of handle 36. Support frame 32 is mounted on a table 38 and is rotatable relatively to the table around a vertical axis 40. The angular adjustability of the groover about both the vertical and horizontal axes allows the groover 30 to be positioned perfectly square to the end of a pipe that cannot be conveniently oriented square to the groover. This occurs, for example, when a pipe assembly comprising bent sections is being grooved, and there is no convenient way to support the entire length of the assembly and bring the end to be grooved square to the groover without constructing special tooling to hold and move the assembly.

Figure 4:
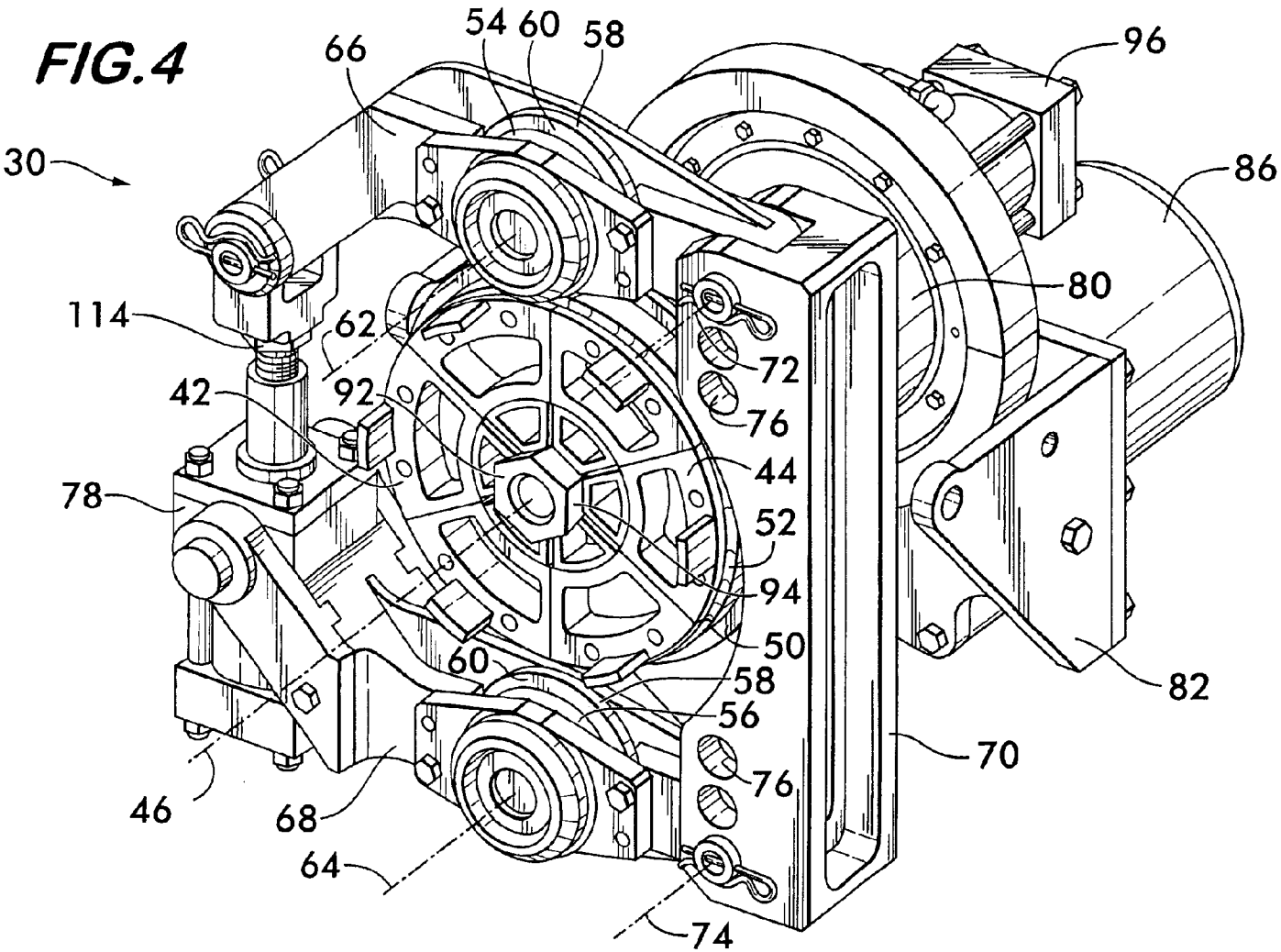
FIG. 4 is a front perspective view of the orbiting roller groover on an enlarged scale.

FIG. 4 shows the orbiting roller groover 30 in detail. Groover 30 includes an expandable die 42 for holding a pipe end so that a circumferential groove may be formed therearound. Expandable die 42 comprises a plurality of wedge shaped die segments 44 positioned around a center axis 46. Die segments 44 are spring biased toward center axis 46 and are movable radially outwardly from that axis to expand the die segments into engagement with the inside surface of the pipe, which is slipped over the expandable die coaxially with the center axis 46 as described below.

The pipe end should be oriented square to the outer surface of the die segments 44 to ensure that the groove 24 is formed circumferentially around the pipe end. To ensure a square relationship, each die segment has a pipe stop surface 50 that extends radially outwardly from each die segment 44. When the pipe end held by the expandable die 42 engages the pipe stop surfaces 50 circumferentially, then the pipe end is oriented square to the outer surface of the die segments 44. The pipe stop surfaces 50 are positioned in spaced relation to a tooling groove 52 in the die segments 44 (described below), the spacing between the pipe stop surfaces 50 and the tooling groove 52 determining the separation between the circumferential groove 24 and the end of the pipe.

Each die segment 44 also has an outwardly facing circumferential tooling groove 52. The tooling grooves are aligned circumferentially around the expandable die and operate to receive material from the pipe displaced radially inwardly by the grooving process. The shape of the tooling grooves 52 helps determine the shape of the bump 26 that forms on the inner surface of a grooved pipe end (see FIG. 2).

A pair of grooving rollers 54 and 56 are positioned adjacent to the expandable die 42 approximately diametrically opposite to one another. Each grooving roller has a circumferential groove forming face 58 with a continuous ridge 60 extending radially outwardly therefrom. Ridge 60 engages the pipe end and forms the groove by cold working the pipe material as described below. Face 58, including ridge 60, are preferably formed of hardened steel so as to effectively cold work the pipe end. Grooving rollers 54 and 56 are each rotatable about respective axes 62 and 64 which are oriented substantially parallel to the center axis 46 of the expandable die 42. The rollers 54 and 56 are positioned so that ridge 60 aligns substantially with tooling groove 52 in the expandable die 42 so that the ridge and tooling groove operate together to form the groove and bump in the pipe end as described below. The rollers 54 and 56 need not align exactly with the center of the tooling groove 52. The rollers may be offset to one side or the other of the groove center as desired, for example, to form a single grove from two overlapping grooves formed by two rollers offset from the groove center by a distance less than their thickness. This procedure is described in greater detail below.

Figure 9:
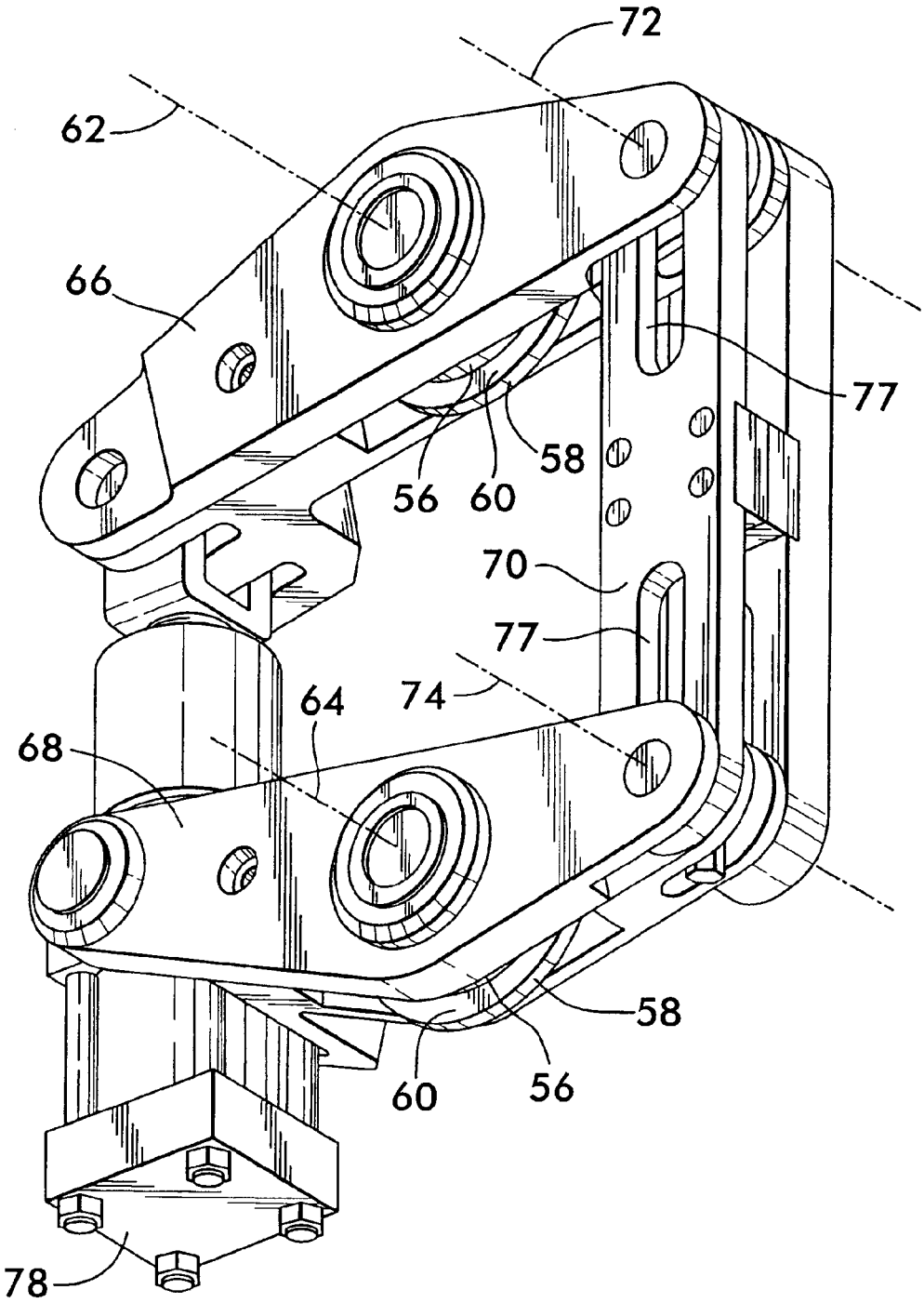
FIG. 9 is a perspective view of a portion of the orbiting roller groover illustrating an alternate embodiment.

Each grooving roller 54 and 56 is rotatably mounted on a respective arm 66 and 68. Arms 66 and 68 are positioned in parallel, spaced relation on opposite sides of the expandable die 42, the arms being oriented transversely to the center axis 46. Each arm is pivotally mounted at one end to a carriage 70 positioned adjacent to the expandable die 42. Arms 66 and 68 pivot about respective axes 72 and 74 which are oriented substantially parallel to center axis 46. This allows the grooving rollers 54 and 56 to be moved toward and away from the expandable die 42 by pivoting the arms 66 and 68 about their respective pivot axes 72 and 74, allowing the rollers to engage a pipe held on the expandable die 42. Carriage 70 has multiple pivot positions formed by a plurality of discrete apertures 76 located within the carriage 70 that allow the pivot axes 72 and 74 of arms 66 and 68 to be adjusted to adapt the grooving rollers 54 and 56 for engagement with pipes of different diameters. An alternate embodiment of carriage 70 is shown in FIG. 9 wherein the multiple pivot positions are provided by a slot 77 which allows for a continuous adjustment of the position of pivot axes 72 and 74 of arms 66 and 68. Continuously adjustable pivot axes provide greater versatility to the orbiting roller groover by allowing a wide range of pipe diameters to be accommodated. Another advantage of continuously adjustable pivot axes is that no stop means is necessary to limit motion of the arms for controlling groove depth. This is explained in detail below.

Arms 66 and 68 are pivoted about axes 72 and 74 by an actuator 78 mounted on carriage 70 through its attachment to the ends of arms 66 and 68 opposite their respective pivot axes 72 and 74. The arms 66 and 68 link the grooving rollers 54 and 56 to the actuator 78, which is preferably hydraulic and provides the force necessary to engage the grooving rollers 54 and 56 with the pipe to form the circumferential groove by cold working the material.

Figure 5:
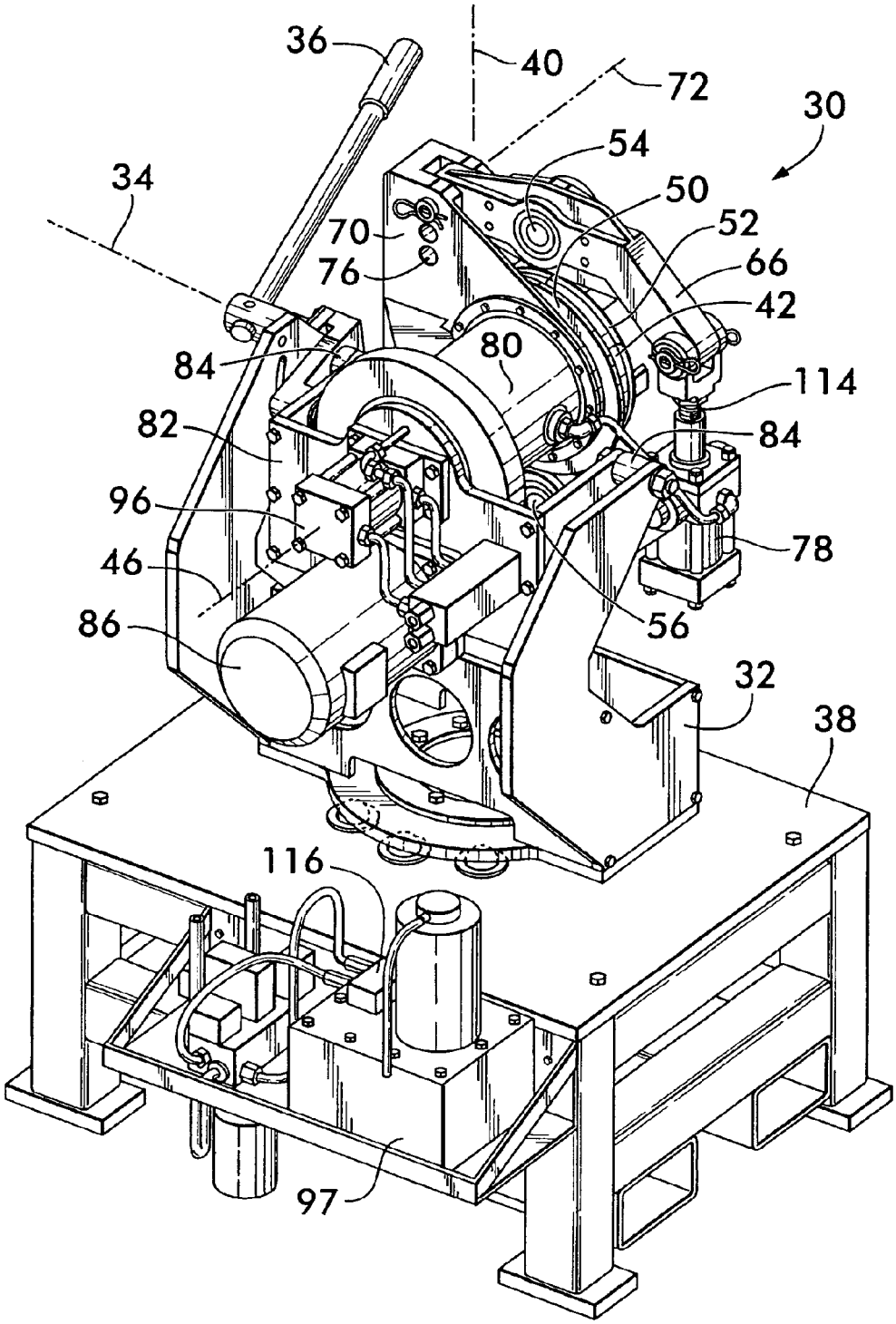
FIG. 5 is a rear perspective view of the orbiting roller groover shown in FIG. 3.

As best shown in FIG. 5, carriage 70 is mounted on a cylindrical housing 80 rotatably attached to an intermediate frame 82. Intermediate frame 82 is mounted to support frame 32 using trunnions 84 which define the horizontal axis 34 about which the orbiting roller groover pivots. Carriage 70 is rotatable about center axis 46 along with housing 80. Rotation of the carriage and housing is effected by an electric motor 86 which is a preferred means for moving the grooving rollers 54 and 56 around the pipe to form the groove therein. Carriage 70, along with arms 66 and 68, grooving rollers 54 and 56 and actuator 78 thus rotate about the expandable die 42 in an orbit around the circumference of a pipe held on the expandable die. As the carriage turns, the actuator 78 forces the grooving rollers 54 and 56 into engagement with the pipe to form the circumferential groove as described below.

Description of Apparatus Operation

Figure 6:
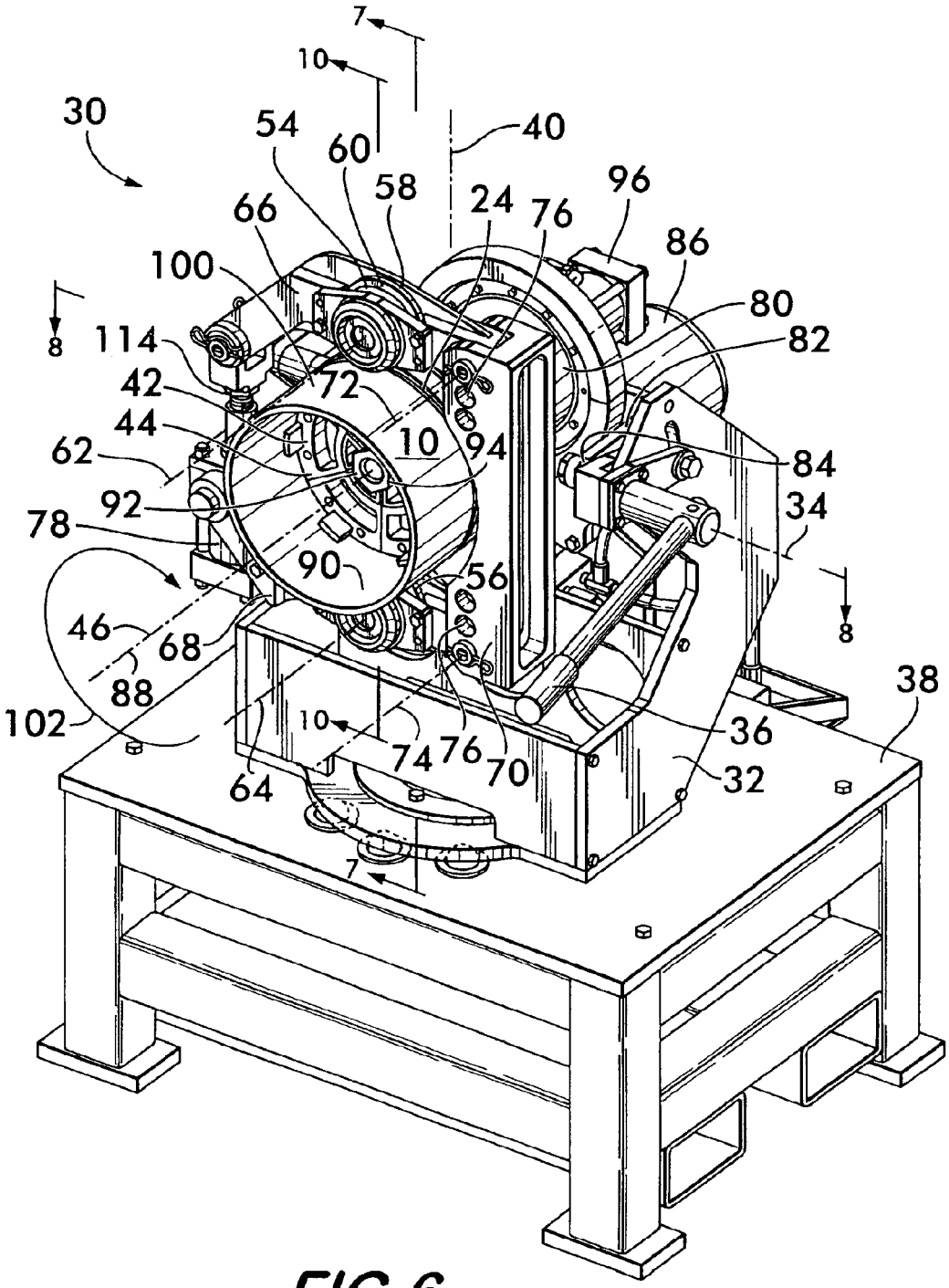
FIG. 6 is a front perspective view of the orbiting roller groover in operation.

As shown in FIG. 6, to form a groove 24 in a pipe end 10, the die segments 44 of the expandable die 42 are permitted to move inwardly under the action of biasing springs (not shown) toward center axis 46, setting the diameter of the expandable die to a size which will fit within the pipe inner diameter. Actuator 78 is used to pivot arms 66 and 68 about pivot axes 72 and 74 away from the expandable die 42. Handle 36 is then used to rotate the orbiting roller groover 30 about horizontal and vertical axes 34 and 40 to position the pipe stop surface 50 square with the pipe end to be grooved. As shown in FIG. 6, the pipe end 10 is engaged with expandable die 42, the long axis 88 of the pipe end 10 being substantially coaxial with the center axis 46. Pipe end 10 is positioned onto the expandable die until it engages stop surfaces 50, whereupon the segments 44 are moved radially outwardly to engage the inner surface 90 of the pipe end 10 and hold the pipe end securely to the orbiting roller groover 30. Die segments 44 are preferably moved by means of a hydraulic ram 92, best shown in FIG. 7. Ram 92 is positioned coaxially with center axis 46 and has a wedge shaped end 94 (see also FIG. 4) that engages the die segments 44. A hydraulic cylinder 96 coupled to the ram 92 moves the ram along center axis 46 as shown by the arrow 98. Hydraulic cylinder 96 is actuated by a hydraulic power unit 97 shown in FIG. 5. Movement of the ram toward the hydraulic unit engages the wedge end 94 with the die segments 44, forcing them outwardly into engagement with the inner pipe surface 90. (Conversely, movement of the ram away from the hydraulic unit allows the die segments to move radially inwardly under the force of their biasing springs.)

Figure 7:
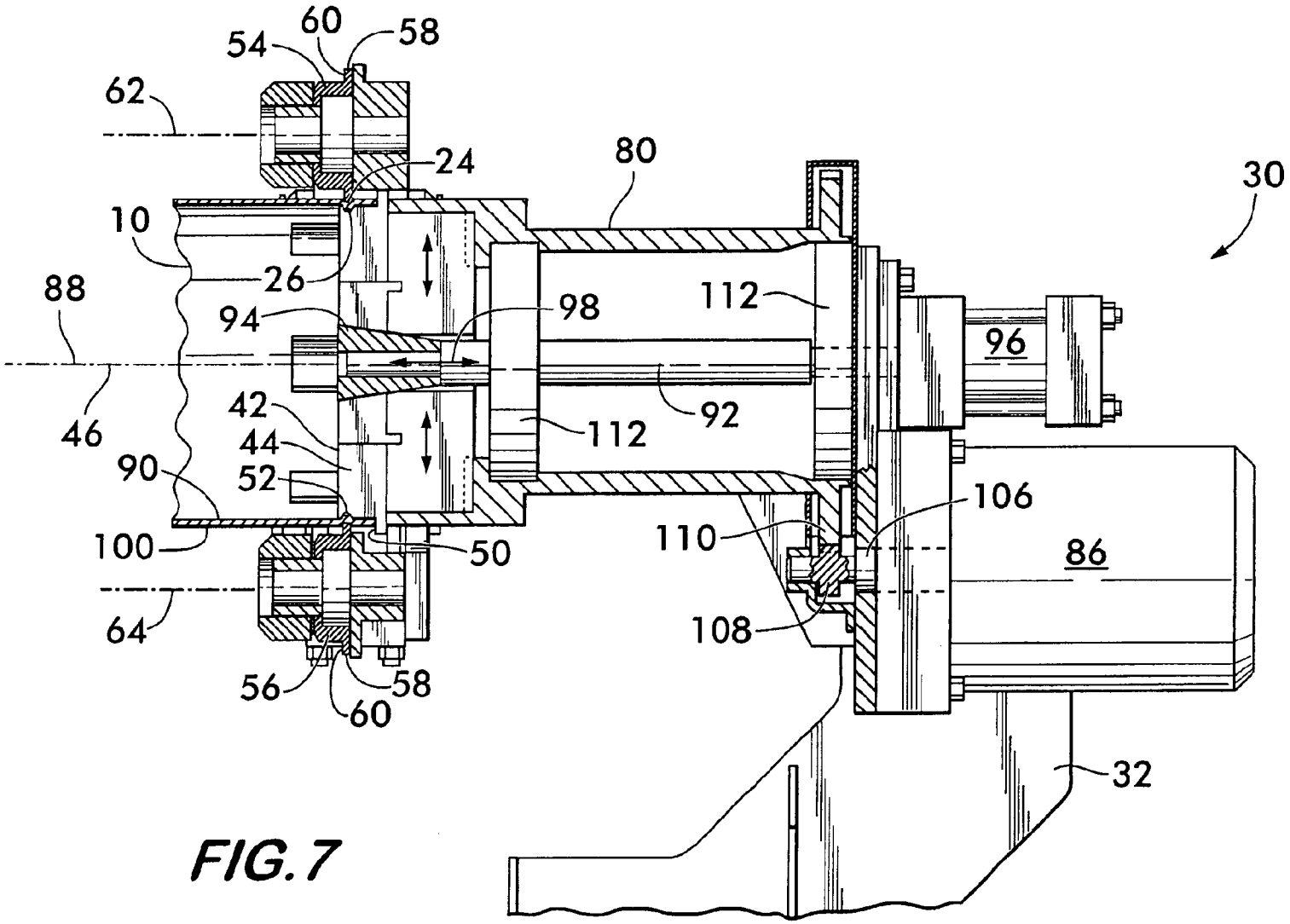
FIG. 7 is a sectional view taken along lines 7—7 of FIG. 6.
Figure 8:
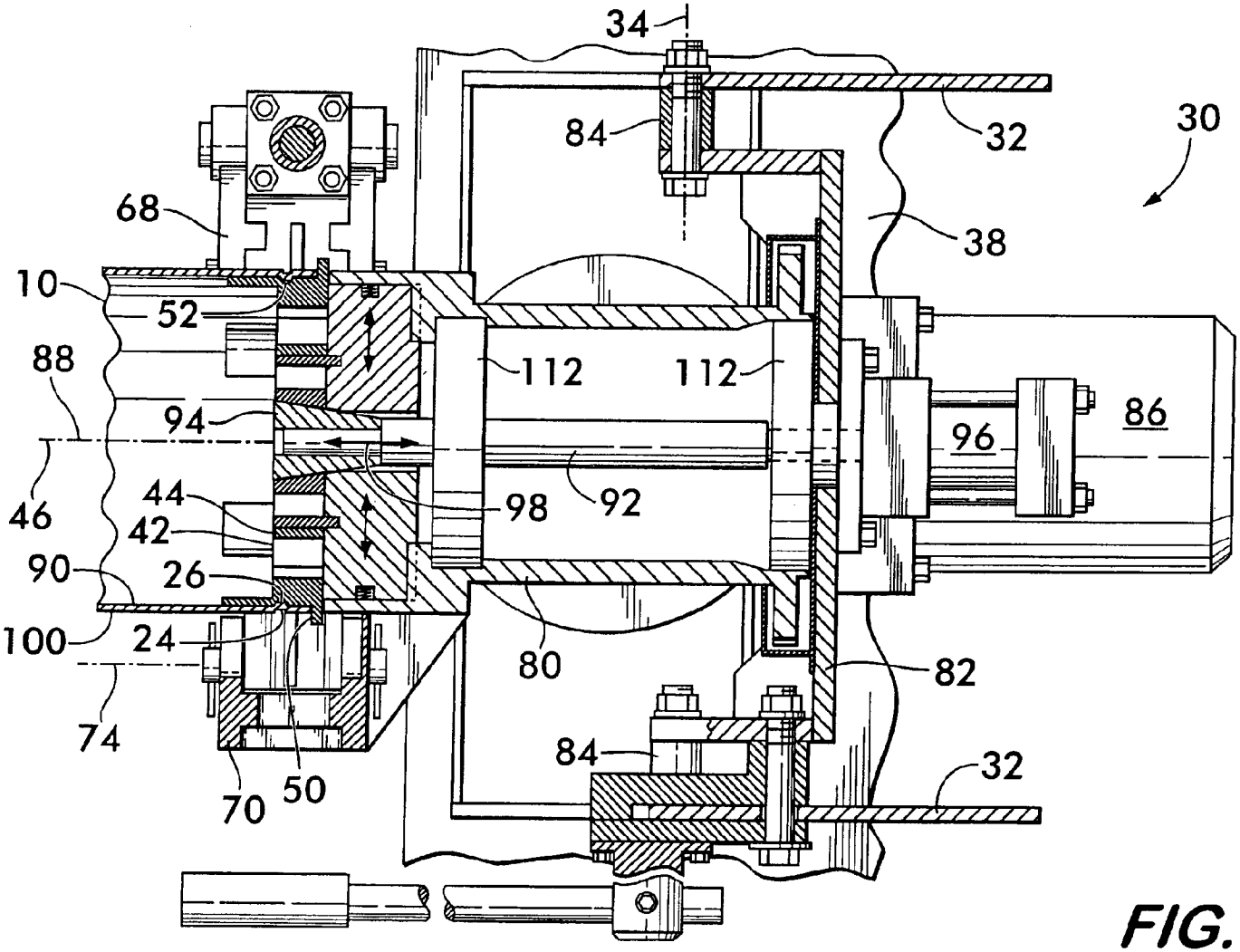
FIG. 8 is a sectional view taken along lines 8—8 of FIG. 6.

As shown in FIG. 6, actuator 78, preferably also actuated by the hydraulic power unit 97, is used to move arms 66 and 68 about their respective pivot axes 72 and 74, to position the grooving rollers 54 and 56 into contact with the outer surface 100 of pipe end 10. Carriage 70 is then rotated about center axis 46 as indicated by arrow 102. This moves grooving rollers 54 and 56 in their orbit about pipe end 10. As shown in FIG. 7, rotation of the carriage 70 is effected by electrical motor 86 having a shaft 106 with a pinion 108 engaging a gear 110 coupled to the carriage 70 by housing 80. As shown in FIGS. 7 and 8, housing 80 is mounted on bearings 112 for rotation of the housing 80, carriage 70, arms 66 and 68, grooving rollers 54 and 56 and actuator 78 about the axis 46 and the expandable die 42.

As the grooving rollers rotate in their orbit the actuator applies increasing force to press the ridge 60 into the outer surface 100 of pipe 10, cold working the pipe material and forming the groove 24. As shown in FIG. 8, the inner surface 90 of the pipe 10 is forced into the tooling groove 52 of the die segments 44 forming the bump 26. Motion of the actuator 78 is controlled by an adjustable stop 114 (see FIG. 4) which may be set to limit the travel of the grooving rollers 54 and 56 so that a groove 24 of the desired depth and outer diameter, appropriate to the mechanical pipe clamp being used, is formed. The separation of the grooving rollers 54 and 56 may be used to determine when a groove having the desired outer diameter has been formed. An adjustable stop 114 for the actuator 78 is unnecessary if the position of the pivot axes 72 and 74 are infinitely adjustable using the slots 77 as shown in FIG. 9. The desired depth of the groove 24 is achieved by setting the positions of the pivot axes 72 and 74 relatively to one another so that a full stroke of actuator 78 will position the rollers 54 and 56 at the proper separation distance to form the groove to the desired depth.

Figure 1:
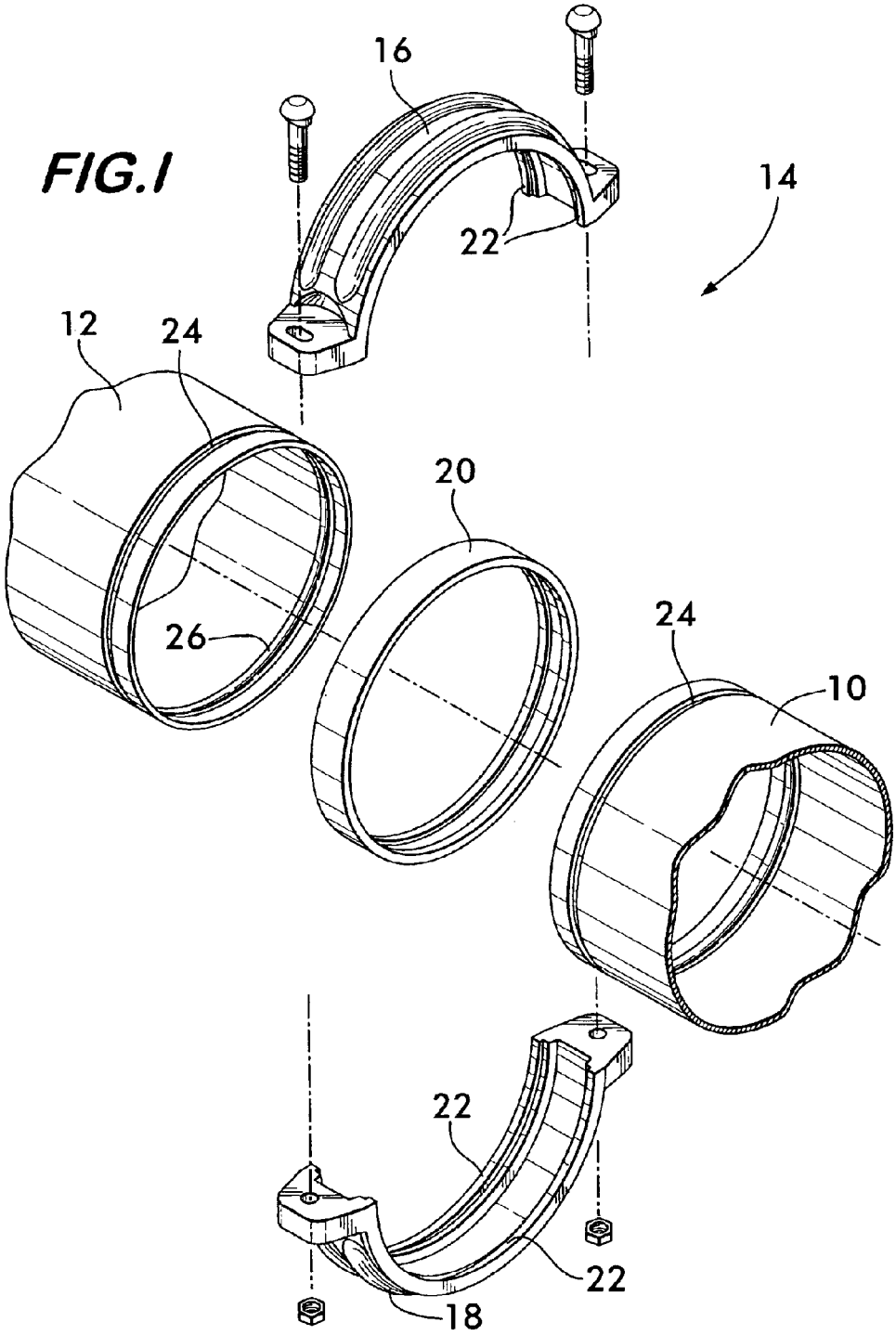
FIG. 1 is an exploded perspective view of a mechanical pipe coupling joining pipe ends together.
Figure 2:
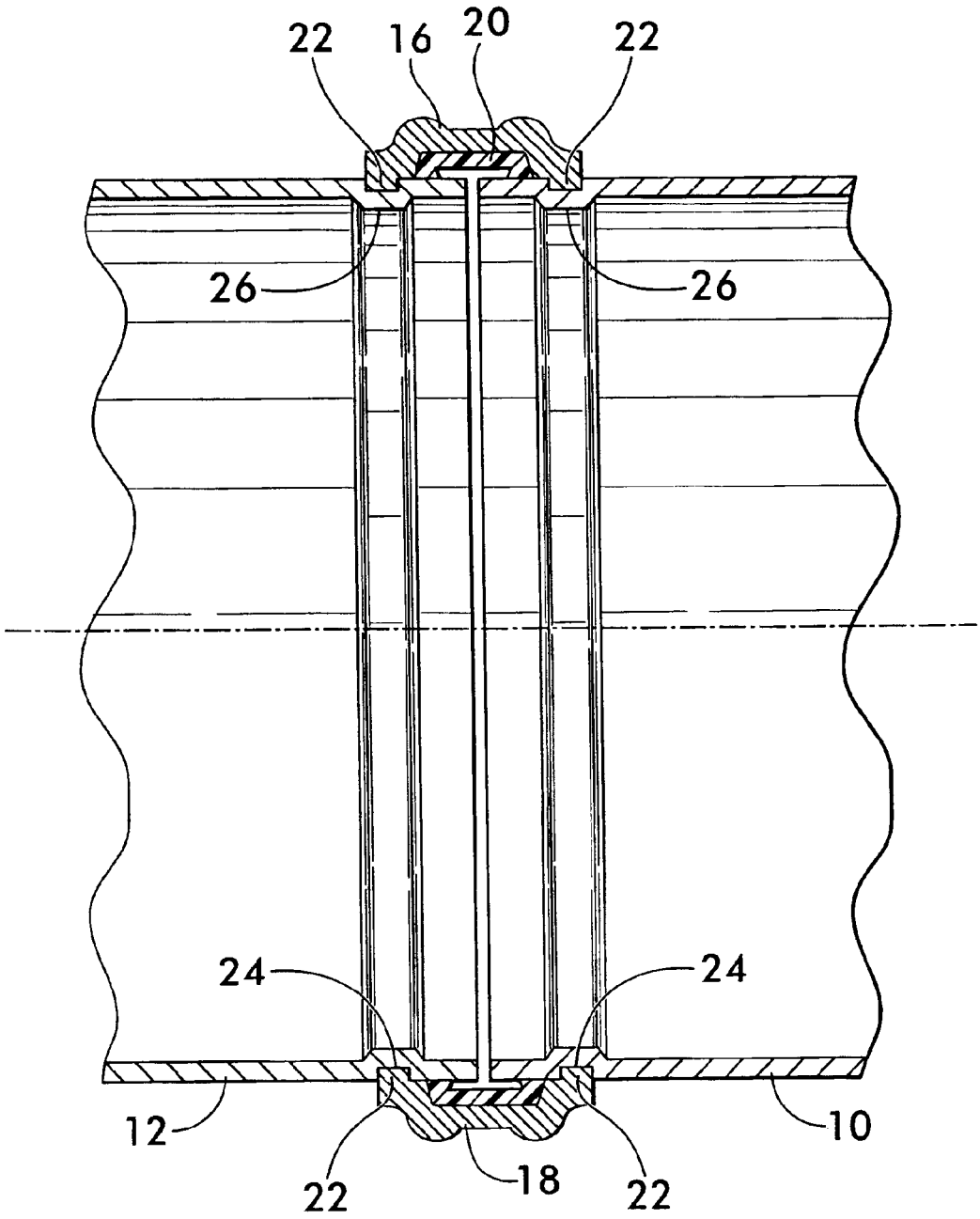
FIG. 2 is a longitudinal sectional view of the pipe coupling shown in FIG. 1.

In an alternate mode of operation particularly suited to roller groover devices having two opposed grooving rollers 54 and 56 as illustrated in FIG. 2, the carriage 70 may be rotated about axis 46 in a reciprocating manner to move the rollers 54 and 56 in partially overlapping arcs subtending angles greater than 180 degrees. This will form the continuous circumferential groove 24 without moving the rollers 54 and 56 in an orbit around the pipe 10.

Once the proper groove 24 has been formed completely around the pipe end 10; the rotation of the carriage 70 is stopped, the arms 66 and 68 are pivoted away from the pipe end 10 removing the grooving rollers 54 and 56 from engagement with the groove 24 and the pipe outer surface 100. The ram 92 is moved by the hydraulic cylinder 96 to disengage the wedge end 94 from the die segments 44, allowing the die segments to move inwardly, disengaging from the inner surface 90 of the pipe end 10 sufficient to clear the bump 26, thereby releasing the pipe end from the orbiting roller groover.

Hydraulic pressure to the actuator 78 is preferably through a pressure compensated flow control valve 116 (see FIG. 5). Such a valve passes the same amount of fluid per unit time to the actuator regardless of the change in cylinder pressure. This allows the apparatus to form the groove 24 at a fixed rate per revolution of the carriage 70. The constant rate per revolution of groove formation is chosen to avoid deforming the pipe in ways that are undesirable. For example, if too small a groove increment is taken per revolution, then there is not enough force between the grooving rollers and the die to force the pipe material inwardly so that bump 26 is formed. The material compressed by the grooving rollers flows outwardly from the groove along the pipe, causing an increase in pipe length and diameter. For thick walled pipes, a bump on the outside surface will form adjacent to the groove as the compressed material must flow somewhere, and the adjacent free surface provides a convenient path of least resistance. On the other hand, if too great an increment is taken per revolution, the force applied by the grooving rollers and die tend to bend the end of the pipe wall outwardly, causing the pipe end to flare. Such high force between the roller and the pipe will also require high torque output from the motor to rotate the carriage, resulting in excessive electrical power requirements needed to run the apparatus. Furthermore, higher strength components will also be required for high torque output.

The problems associated with either too small or too great a grooving increment are avoided, however, by using the pressure compensated flow control valve to achieve a constant grooving rate per revolution having sufficient force applied by the grooving rollers to force most of the material inwardly to form bump 26, but not too much force such that the end of the pipe flares or excessive power consumption is manifest during operation.

Another method of limiting the force needed between the rollers 54, 56 and the pipe end 10 to form the groove 24 is by using rollers having ridges 60 narrower than the desired groove width, and staggering the rollers along their respective axes of rotation 62 and 64 relatively to one another so that they form two grooves which overlap to form the groove 24 having the desired width. Thus, when staggered, each roller forms a portion of the groove 24, and less force is needed on each roller because less metal must be cold worked by each roller.

Figure 10:
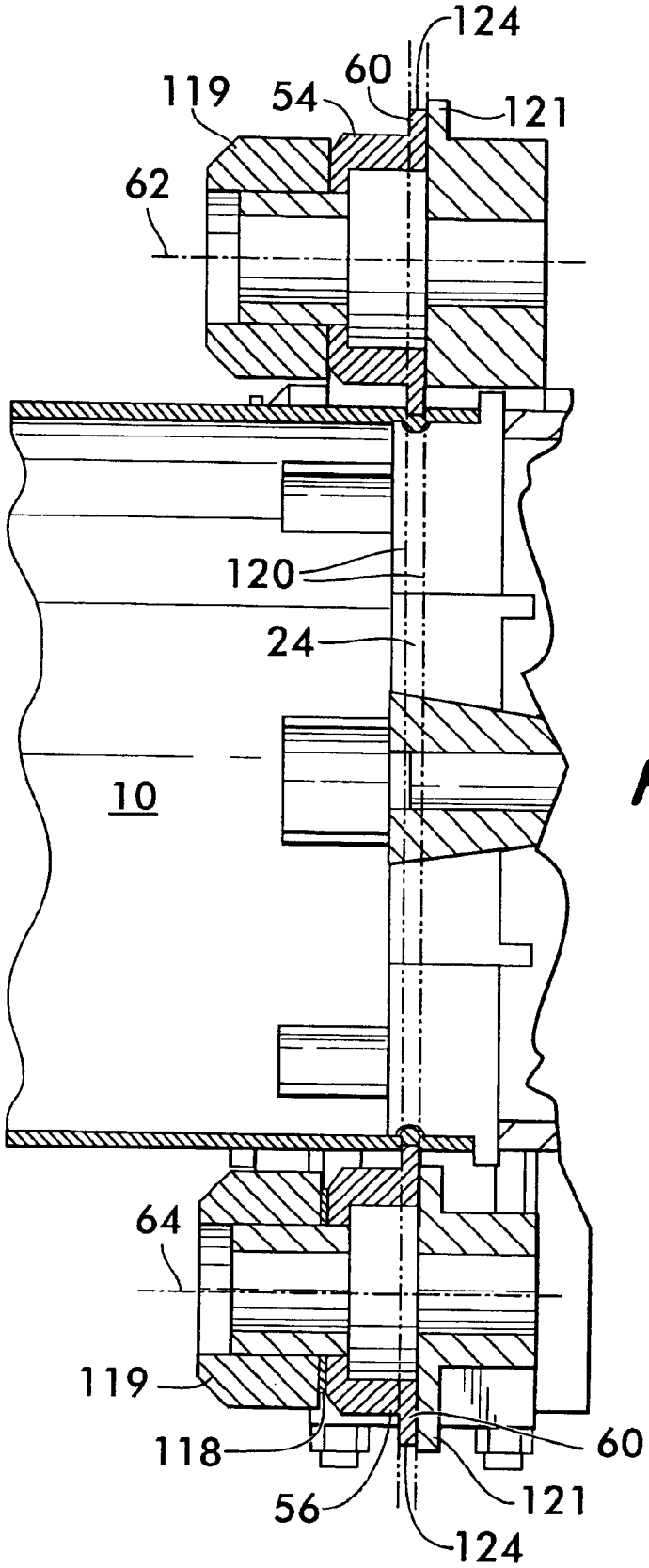
FIGS. 10 and 11 are cross-sectional views taken through lines 10—10 of FIG. 6.
Figure 11:
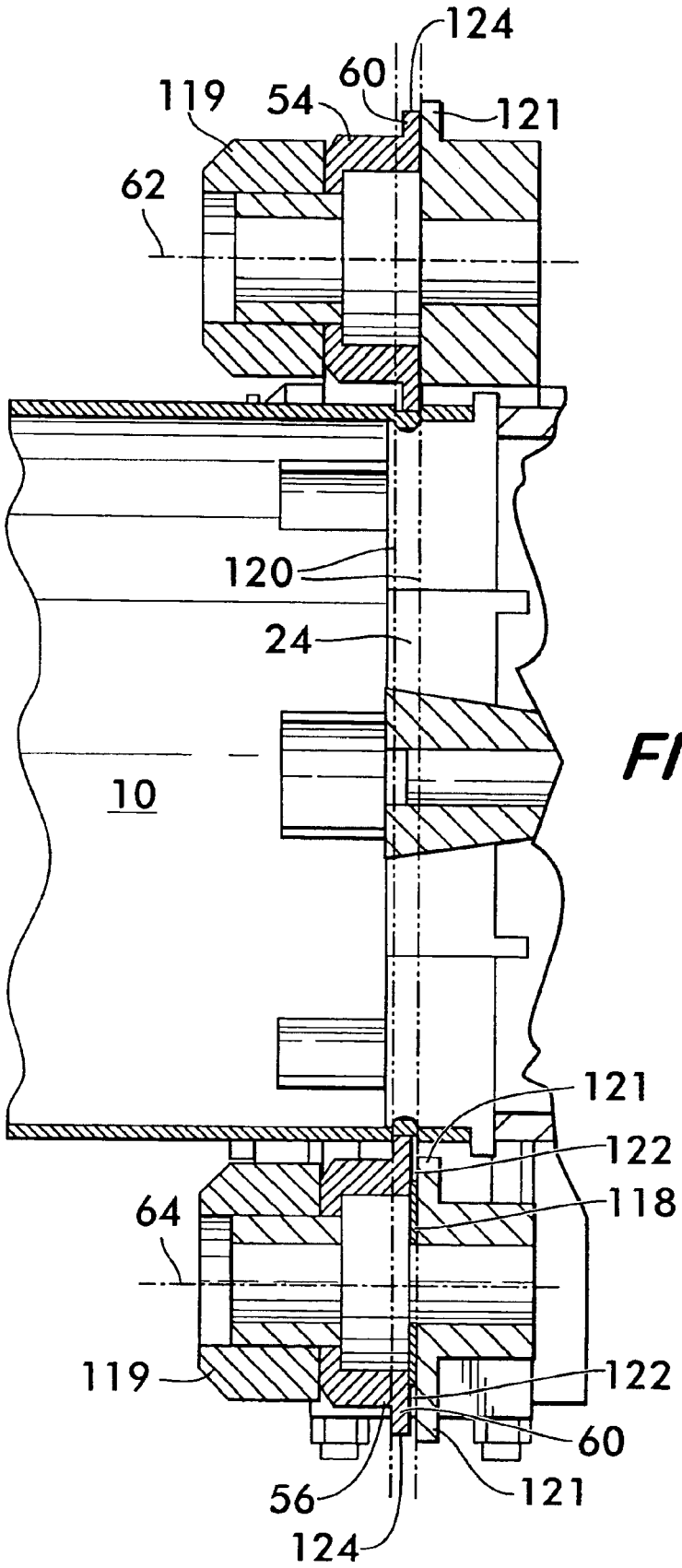

FIGS. 10 and 11 show a roller arrangement wherein the rollers 54 and 56 may be aligned with one another to both form the same groove 24 (FIG. 10) or staggered relatively to one another (FIG. 11) along axes 62 and 64 so that they form two grooves which overlap to form the groove 24.

Relative staggering of the rollers 54 and 56 is preferably effected by means of a spacer 118 which may be placed on one side or the other of one of the rollers to stagger it relatively to the other. Spacer 118 may be in the form of a washer-like ring, a partial ring, a shim or other such item. As shown in FIG. 10, spacer 118 is placed outboard of roller 56 between the roller and the roller retaining cap 119. This causes the ridges 60 of rollers 54 and 56 to align with one another as indicated by the broken lines 120 and form a common groove 24 in the pipe end 10 as they orbit. However, placing the spacer 118 inboard of the roller 56 between the roller and the roller bearing flange 121 as shown in FIG. 11 displaces ridge 60 outboard along axis 64, staggering roller 56 relatively to roller 54 as indicated by the space 122 between ridge 60 on roller 56 and the roller bearing flange 121. As the rollers orbit they will each form separate grooves which overlap to form groove 24.

Having a variably positionable grooving roller 54 also increases the versatility of the orbiting roller groover, allowing it to process a wide range of pipe diameters without the need to change out the grooving rollers 54 and 56. For example, for pipe of nominal diameter between 0.75 and 1.5 inches the desired groove width is 0.281 inches. For pipes of nominal diameter, between 2 and 6 inches the desired groove width is 0.344 inches, the difference in groove widths being about 0.063 inches. It is possible by using variably positionable grooving rollers to cover the entire range of pipe diameters between 0.75 and 6 inches with rollers having a single width ridge 60. This is accomplished by making the width 124 of ridge 60 on both rollers 54 and 56 equal to 0.281 inches, the same as the groove width for pipe between 0.75 and 1.5 inches nominal diameter, and placing the spacer 118 in the outboard position shown in FIG. 10 to align the rollers 54 and 56 along their rotation axes 62 and 64 so that they both form the same groove 24. To convert the orbiting roller groover to handle the larger diameter pipe, the spacer 118 is shifted to the inboard position shown in FIG. 11. This shifts the position of ridge 60 on roller 56 by 0.063 inches relative to ridge 60 on roller 54. Since the ridges are 0.281 wide, they still overlap because they are staggered by only 0.063 inches. Being staggered, however, each roller 54 and 56 forms a separate groove 0.281 inches wide, the grooves overlapping by 0.218 inches and, thus, forming a single groove 24 having a width of 0.344 inches appropriate for the larger diameter pipe.

Orbiting roller groovers according to the invention makes grooving of pipe and pipe assemblies safe and economical, thereby allowing mechanically joined pipe to be used in applications for which it was previously thought inappropriate or impractical.

What is claimed is:

1. An apparatus for forming a circumferential groove in a pipe, said apparatus comprising:

an expandible die having a plurality of segments positioned around a center axis, said segments being movable radially outwardly to engage an inner surface of said pipe for holding said pipe, said segments being movable radially inwardly away from said inner surface to release said pipe;

a grooving roller having a circumferential groove forming surface engageable with said pipe, said grooving roller being rotatable about an axis of rotation oriented substantially parallel to said long axis of said pipe and being movable around the circumference of said pipe, said segments of said expandible die each have a groove therein facing the inner surface of said pipe, said grooves being aligned with one another circumferentially around said die, said grooves being further substantially aligned with said groove forming surface of said grooving roller and receiving material displaced from said pipe when said circumferential groove is formed therein;

an actuator linked with said grooving roller for forcibly engaging said groove forming surface with said pipe when said grooving roller moves around the circumference of said pipe;

a carriage mounted on said expandible die and rotatable about said center axis;

an arm having one end pivotally attached to said carriage and extending outwardly therefrom transversely to said center axis, said grooving roller being rotatably mounted on said arm, said arm being pivotally movable toward and away from said expandible die, said actuator being mounted on said carriage and engaging another end of said arm for pivotally moving said arm toward and away from said expandible die, said actuator being adapted to forcibly move said circumferential groove forming surface into engagement with said pipe when said pipe is held by said expandible die, said carriage, arm, actuator and grooving roller being rotatable about said pipe to form said circumferential groove therein; and means for moving said grooving roller around said pipe.

2. An apparatus according to claim 1, wherein said grooving roller is movable in an orbit around the circumference of said pipe.

3. An apparatus according to claim 1, wherein said grooving roller is reciprocably movable through an arc around the circumference of said pipe.

4. An apparatus according to claim 1, further comprising:

a second arm having one end pivotally attached to said carriage and extending outwardly therefrom transversely to said center axis, said second arm being positioned in spaced relation to said first named arm, said expandible die being located between said arms;

a second grooving roller being rotatably mounted on said second arm and positioned diametrically opposite to said first named grooving roller, said second grooving roller having a circumferential groove forming surface engageable with said pipe, said second arm being pivotally movable toward and away from said expandible die; and said actuator engaging said other end of said second arm for pivotally moving said arms toward and away from said expandible die, said actuator being adapted to forcibly move said circumferential groove forming surfaces into engagement with said pipe when said pipe is held by said expandible die, said carriage, arms, actuator and grooving rollers being rotatable about said pipe to form said circumferential groove therein.

5. An apparatus according to claim 1, wherein said actuator comprises a hydraulic actuator using hydraulic fluid and having a pressure compensated flow control valve, said pressure compensated flow valve passing the same amount of said hydraulic fluid to said actuator regardless of the change in pressure within said actuator.

6. An apparatus for forming a circumferential groove in a pipe having a lengthwise oriented long axis, said apparatus comprising:

a holding fixture adapted to releasably engage and hold said pipe, said holding fixture being mounted for rotation about a first axis and a second axis perpendicular to said first axis for aligning said holding fixture with said long axis of said pipe;

a grooving roller having a circumferential groove forming surface engageable with said pipe, said grooving roller being mounted adjacent to said holding fixture and movable relatively thereto around the circumference of said pipe, said grooving roller having an axis of rotation located coaxially with said circumferential groove forming surface, said grooving roller being rotatable about said first and second axes with said holding fixture so as to align said axis of rotation of said grooving roller substantially parallel to said long axis of said pipe;

an actuator linked with said grooving roller for forcibly engaging said groove forming surface with said pipe when said grooving roller moves around the circumference of said pipe; and means for moving said grooving roller around said pipe.

7. An apparatus according to claim 6, wherein said first axis is horizontally oriented and said second axis is vertically oriented.

8. An apparatus according to claim 6, further comprising:

a carriage mounted on said holding fixture and rotatable along with said grooving roller;

an arm having one end pivotally attached to said carriage and extending outwardly therefrom transversely to said grooving roller axis of rotation, said grooving roller being rotatably mounted on said arm, said arm being pivotally movable toward and away from said holding fixture; and said actuator being mounted on said carriage and engaging another end of said arm for pivotally moving said arm toward and away from said expandible die, said actuator being adapted to forcibly move said circumferential groove forming surface into engagement with said pipe when said pipe is held by said expandible die, said carriage, arm, actuator and grooving roller being rotatable about said pipe to form said circumferential groove therein.

9. An apparatus according to claim 8, wherein said one end of said arm is pivotably positionable at a plurality of pivot positions located in spaced relation to one another on said carriage thereby adapting said grooving roller for engaging pipes having various diameters.

10. An apparatus according to claim 9, wherein said pivot positions are defined by a plurality of discrete apertures located within said carriage, said one end of said arm being pivotally mountable within any of said apertures for moving said grooving roller into and out of engagement with said pipe.

11. An apparatus according to claim, 9 wherein said pivot positions are defined by a slot located within said carriage, said one end of said arm being slidably mountable within said slot and pivotable for moving said grooving roller into engagement with said pipe.

12. An apparatus for forming a circumferential groove in a pipe having a lengthwise oriented long axis, said apparatus comprising:

a holding fixture adapted to releasably engage and hold said pipe;

a carriage mounted adjacent to said holding fixture and rotatable relative thereto about an axis centered on said long axis of said pipe;

first and second arms positionable on opposite sides of said pipe, said arms extending transversely to said long axis, each arm having a first end pivotably mounted on said carriage for motion of said arms toward and away from said pipe;

first and second grooving rollers rotatably mounted respectively on said first and second arms, each of said grooving rollers having a circumferential groove forming surface engageable with said pipe, said grooving rollers being rotatable about respective axes of rotation oriented substantially parallel to said long axis of said pipe, said grooving rollers being movable around the circumference of said pipe with said arms and said carriage;

an actuator extending between said first and second arms and positioned in spaced relation to said first ends thereof, said actuator for pivoting said arms for forcibly engaging said groove forming surfaces of said grooving rollers with said pipe when said grooving rollers move around the circumference of said pipe; and means for moving said carriage, said arms, said actuator and said grooving rollers around the circumference of said pipe.

13. An apparatus according to claim 12, wherein said grooving rollers are movable in an orbit around the circumference of said pipe.

14. An apparatus according to claim 12, wherein said grooving rollers are reciprocably movable through an arc around the circumference of said pipe.

15. An apparatus according to claim, 12 wherein said circumferential groove forming surfaces each comprise a ridge projecting radially outwardly from and extending circumferentially around said grooving rollers, said ridges being engageable with said pipe for forming said circumferential grove in its outer surface when said grooving rollers are rotated around said pipe.

16. An apparatus according to claim 15, wherein said holding fixture comprises an outwardly facing circumferential groove positioned substantially in alignment with said ridges on said grooving rollers, said outwardly facing circumferential groove for receiving a portion of said pipe displaced inwardly when said circumferential groove is formed therein.

17. An apparatus according to claim 16 further comprising a pipe stop surface positioned on said holding fixture in spaced relation to said outwardly facing circumferential groove, said pipe stop surface for engaging an end of said pipe positioned on said holding fixture and thereby locating said pipe relative to said ridges on said grooving rollers.

18. An apparatus according to claim 15, wherein said ridges on each of said grooving rollers are aligned with one another in a common plane.

19. An apparatus according to claim 18, wherein said ridges are equal in thickness to one another.

20. An apparatus according to claim 15, wherein said ridges on each of said grooving rollers are positioned in staggered relation relative to one another in a direction along said axes of rotation of said grooving rollers.

21. An apparatus according to claim 20, wherein said ridges are staggered with a spacing relative to one another less than the thickness of said ridges so as to produce circumferential grooves in said pipe which overlap one another.

22. A method of forming a single circumferential groove in a pipe having a lengthwise oriented long axis and a surface, said method comprising the steps of:

fixing the pipe in a position;

providing first and second rotatable grooving rollers, each having respective first and second circumferential groove forming surfaces engageable with said pipe, each said groove forming surface having a predetermined width, each said groove roller being movable around the circumference of said pipe, said first groove forming surface being positioned in a staggered relation relative to said second groove forming surface with a spacing less than said width of said groove forming surfaces and in a direction along said long axis of said pipe;

forcibly engaging said grooving rollers with said surface of said pipe; and moving said grooving rollers circumferentially around said pipe in an orbit centered on the long axis of said pipe so as to produce first and second circumferential grooves in said pipe which overlap one another to form said single circumferential groove.

23. An apparatus for forming a single circumferential groove in a pipe, said apparatus comprising:

a holding fixture adapted to releasably engage and hold said pipe;

first and second grooving rollers, each having respective first and second circumferential groove forming surfaces engageable with said pipe, each said groove forming surface having a predetermined width, each said grooving roller being rotatable about a respective axis of rotation oriented substantially parallel to said long axis of said pipe and being movable around the circumference of said pipe, said first groove forming surface being positioned in a staggered relation relative to said second groove forming surface with a spacing less than said width of said groove forming surfaces and in a direction along said axes of rotation of said grooving rollers so as to produce circumferential grooves in said pipe which overlap one another to form said single circumferential groove;

an actuator linked with said first and second grooving rollers for forcibly engaging said first and second groove forming surfaces with said pipe when said grooving rollers move around the circumference of said pipe; and means for moving said grooving rollers around said pipe.

* * * * *